United States Patent [19]

Hinden

[11] Patent Number: 4,561,475

[45] Date of Patent: Dec. 31, 1985

[54] UNIVERSAL STRAP TIGHTENING TOOL

[76] Inventor: Milton Hinden, Rte. 110, Farmingdale, N.Y. 11735

[21] Appl. No.: 595,516

[22] Filed: Mar. 30, 1984

[51] Int. Cl.[4] ..... B21F 9/02

[52] U.S. Cl. ..... 140/123.5; 81/9.3

[58] Field of Search ..... 140/123.5, 123.6, 93.2, 140/93 A; 81/9.3

[56] References Cited

U.S. PATENT DOCUMENTS

| | | | |
|---|---|---|---|
| 3,047,945 | 8/1962 | Logan | 81/9.3 |
| 3,169,560 | 2/1965 | Caveney et al. | 140/123.6 |
| 3,173,456 | 3/1965 | Bailey | 140/123.6 |
| 3,993,109 | 11/1976 | Fortsch | 140/123.6 |
| 4,306,592 | 12/1981 | Drage | 140/123.5 |

*Primary Examiner*—Lowell A. Larson

*Attorney, Agent, or Firm*—Mark T. Basseches; Paula T. Basseches

[57] ABSTRACT

The present invention relates to a strap tightening tool adapted to be used with straps of a variety of thicknesses including relatively thin metallic straps and thicker polymeric straps. The tool includes a spring biased pawl having two or more sets of teeth, the teeth of each set being offset from the pivot point of the pawl by varying distances so as to enable an appropriate set of teeth to clamp straps in accordance with the thickness thereof. The device may include a guide to extend between the pulling mechanism and the buckle of the strap to assure that the strap emerges from the buckle at an exit angle essentially parallel to the passage through the buckle.

1 Claim, 13 Drawing Figures

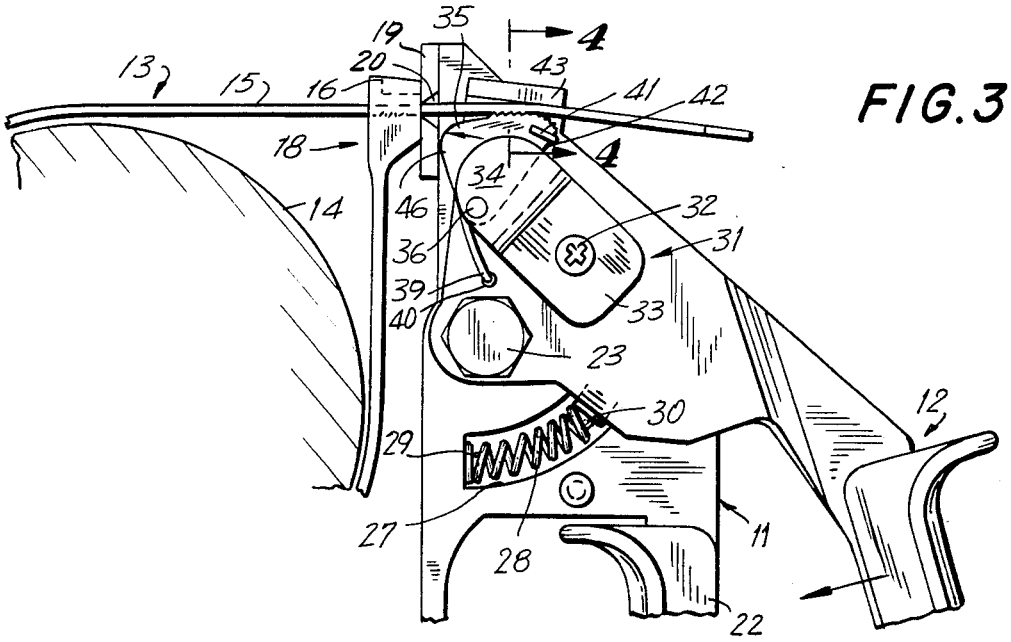
FIG. 3
FIG. 4
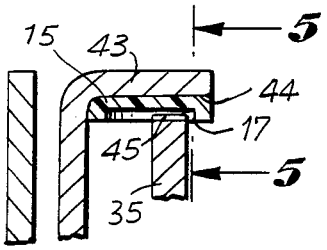
FIG. 5
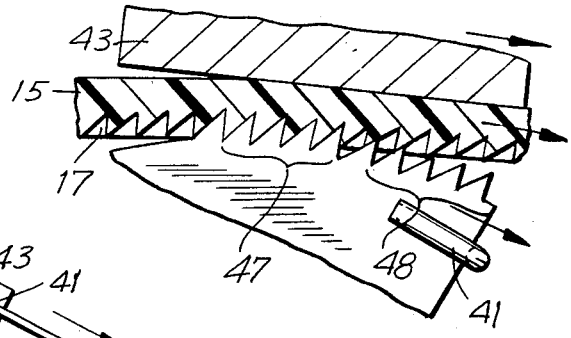
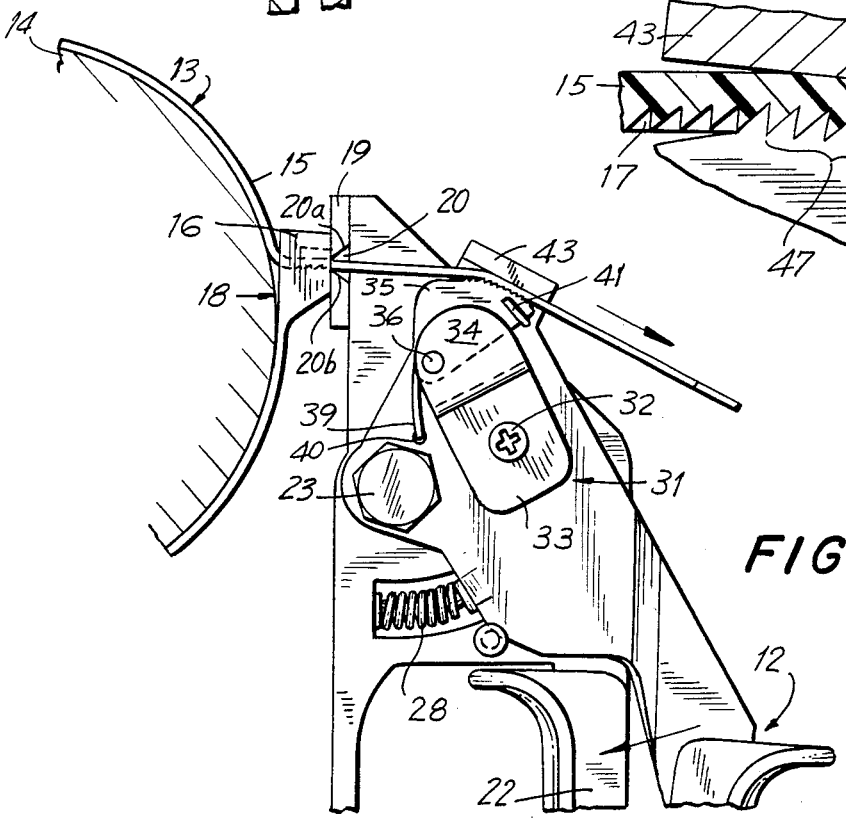
FIG. 6

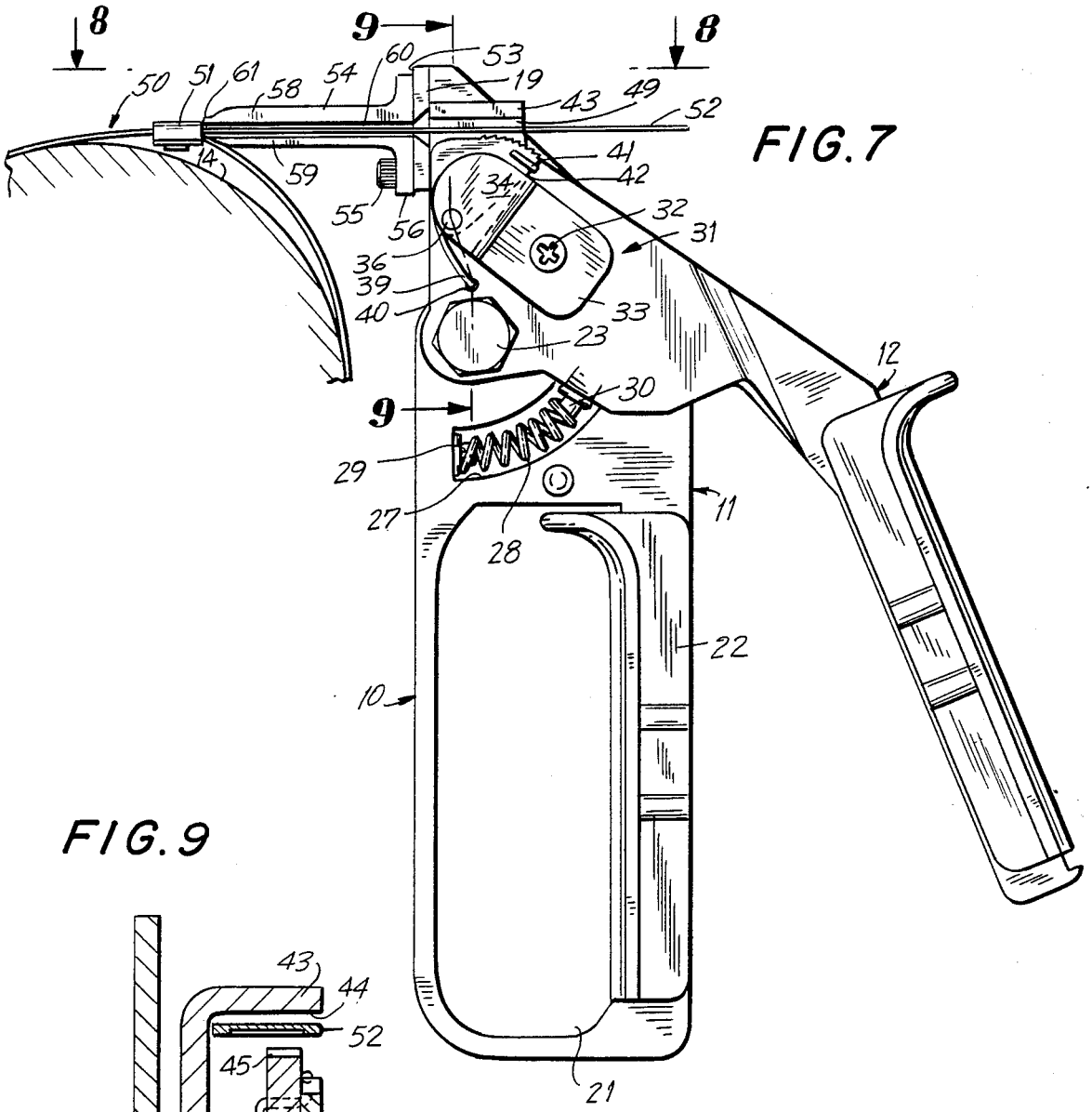
FIG. 7
FIG. 9
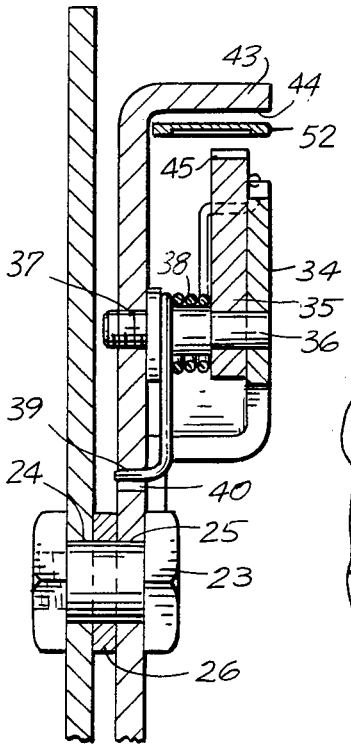
FIG. 8
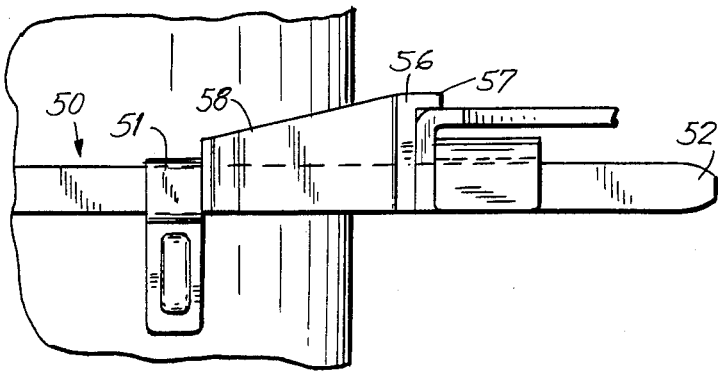

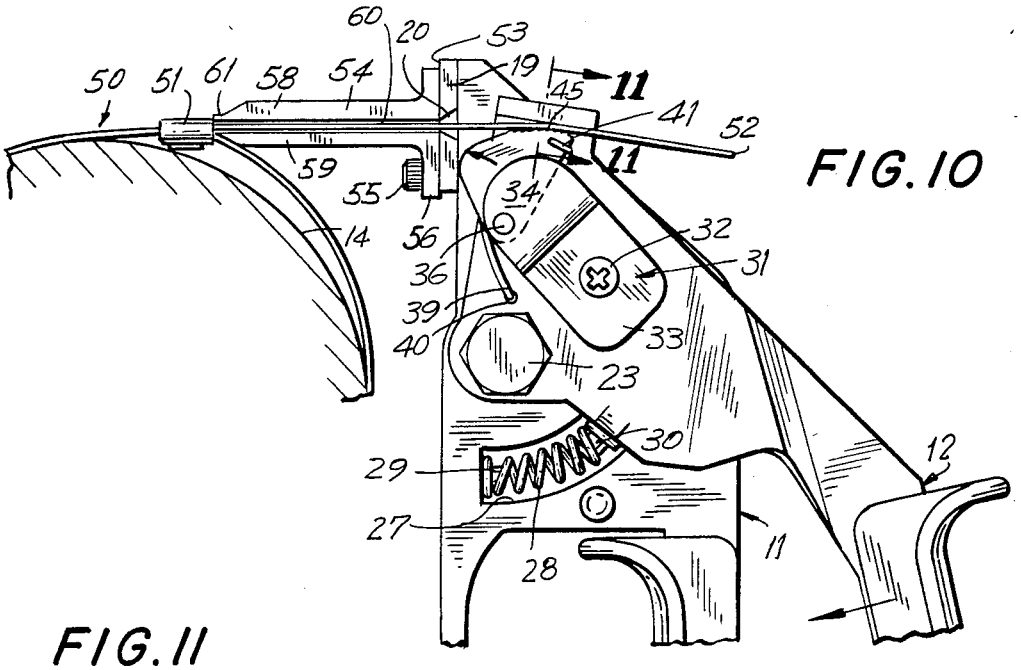
FIG. 10
FIG. 11
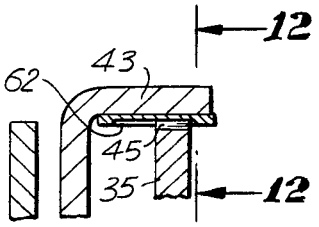
FIG. 12
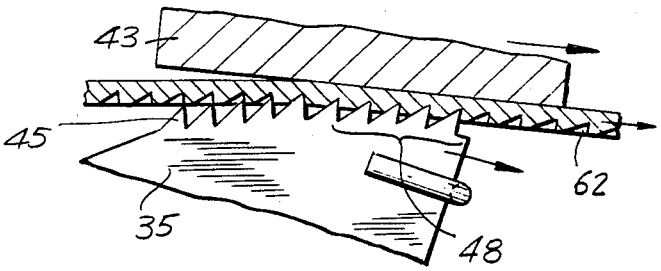
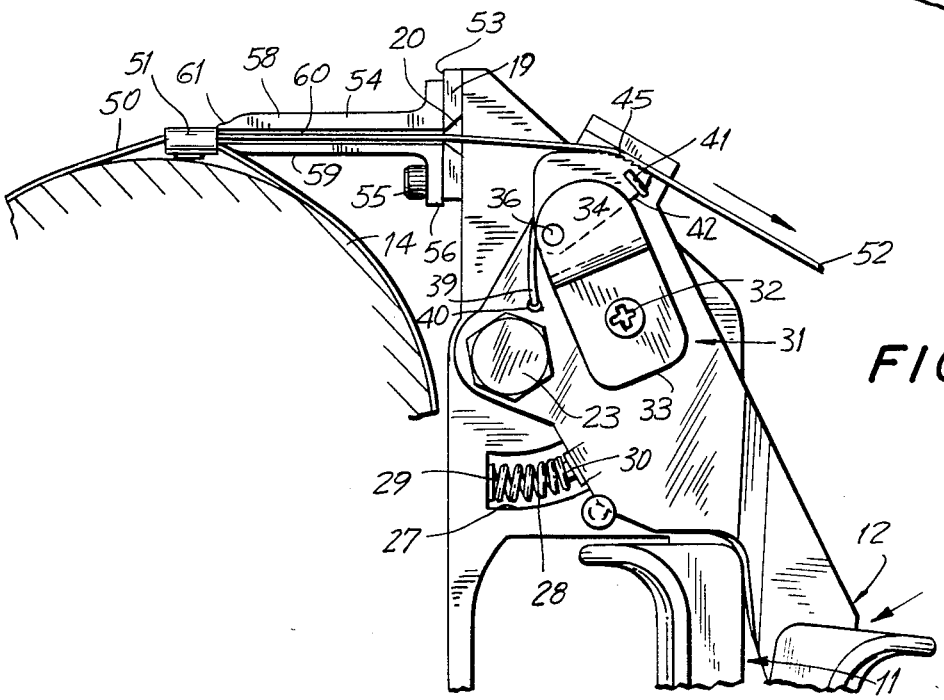
FIG. 13

UNIVERSAL STRAP TIGHTENING TOOL

BACKGROUND OF THE INVENTION

1. Field of the Invention

The present invention is directed to a tightening tool for straps of the type used as cable, hose and duct clamps and pertains more particularly to a tool adapted to tighten cable ties of the type shown in Orban U.S. Pat. Nos. 3,368,247 of Feb. 13, 1968 and Caveney 3,537,146 of Nov. 3, 1970, as well as to steel strap fasteners.

2. The Prior Art

Cable or strap fasteners of the type of the above referenced patents comprise elongate plastic straps having an anchoring buckle at one end. Such fasteners are in widespread use and typically include mechanism within the eye of the buckle, such as a pawl or the like, which cooperates with ridges or teeth formed on the strap to permit the strap freely to be drawn through the buckle in a first or tightening direction but prevent return or retractile movement of the strap through the buckle.

While it is feasible manually to tighten straps of the type described about bundles of cable or wire where high pressures are not required, straps are frequently used in the manner of clamps, i.e. are encircled about a hose or fabric wrapping which has been sleeved over a pipe or manifold. In such cases it is highly desirable to tighten the strap down with a high degree of tension so as to eliminate leaks between the hose or wrapping and the encircled pipe or duct. In order to effect tightening of the strap numerous tightening devices have been suggested. Representative examples are shown in Caveney U.S. Pat. Nos. 3,169,560, Feb. 16, 1965; 3,254,680, June 7, 1966; 3,645,302, Feb. 29, 1972; 3,661,187, May 9, 1972; 3,946,769, Mar. 30, 1976; and 3,976,108, Aug. 24, 1976. Other references of similar nature could be cited.

The noted patents include a fixed member which bears against the buckle of the strap and a movable member adapted to grip the teeth of the strap. When the movable member is shifted in a first or tightening direction, the strap is drawn through the buckle. The devices include a pawl which, on a return stroke, release the strap so as to permit free movement between the strap and the tightening device until the tripping mechanism again is shifted to a position adjacent the buckle.

Devices of the type described typically employ a toothed pawl which is spring biased into contact with the tooth section of the strap to provide the necessary gripping of the strap.

A disadvantage of all such devices heretofore known is that the same are adapted to accommodate straps of only a limited thickness range. If, for example, a thin strip is attempted to be used with a tightening device intended to be used with thicker strips, little or no gripping force would be generated, with the result that attempts to tighten the strap would be ineffectual or would result in stripping the teeth from the strap due to inadequate meshing of a sufficient number of pawl teeth with the teeth of the strap.

In an application filed on Mar. 5, 1984 in the name of Charles Giannone and accorded Ser. No. 586,335, entitled Cinching Clamp Device and Method of Attachment there is disclosed a strap formed of thin metallic material having transversely directed spaced teeth or ridges. No known tightening device is capable of use both with the thicker cable ties as represented by the art hereinabove set forth and a thin steel strap as represented by the above referenced application.

SUMMARY OF THE INVENTION

The present invention may be summarized as directed to a strap tightening device suitable for effective use with straps of a wide variety of thicknesses.

The invention is further directed to a tightening device of the type described which may be employed with metallic straps wherein it is desirable to apply tightening tension in a direction which is essentially parallel to the direction of passage of the strap through the buckle.

Whereas in tightening devices for nylon straps it is permissible for the strap passing through the buckle to be pulled in a direction offset from the direction of passage through the buckle by virtue of the flexibility and resilience of the strap and the tear resistance of the buckle, it has been found desirable to pull metallic straps in a direction essentially parallel to the passage through the buckle.

More specifically, the present invention may be summarized as directed to a universal strap tightening tool capable of applying thin metallic straps as well as thicker nylon straps and the like.

The device includes a fixed lever member and a pivotal lever member, the pivotal member including a clamping shoulder and a pawl spring biased toward the clamping shoulder. When the levers are in spread condition, the pawl is deflected away from the clamping shoulder. When the levers are shifted to a contracted position, i.e. in a tightening direction, the teeth of the pawl grip the strap which is disposed between the pawl and the clamping shoulder to effect a tightening of the strap.

As thus far described, the device is conventional.

A characterizing feature of the instant tightening tool resides in the provision of two sets of teeth on the pawl, the sets being displaced different distances from the pivot or mounting point of the pawl to the movable lever member. By this means, when a thin strap is disposed between the clamp shoulder and pawl, a first set of teeth will engage the strap. When a thicker strap is disposed in such position, the second set of teeth of the pawl will engage the strap.

The device thus differs from known tightening tools wherein the pawl is provided with a single set of teeth, with the result that if a thinner than standard strap is intended to be tightened, only one or two teeth may engage the strap and the angle of engagement will be inappropriate to the application of effective tightening pressures, with the resultant stripping of the teeth from the strap.

The device further may include an elongate guide projecting outwardly beyond the tightening components of the tool, which guide includes a nose portion adapted to abut the buckle of a strap being tightened. Through the use of such guide, the strap is drawn through the buckle in a more or less constant angle aligned with the passage through the buckle whereby sharp bends in the strap are avoided.

It is accordingly an object of the invention to provide a strap tightening tool adapted to be self-accommodating to straps of a variety of thicknesses.

A further object of the invention is the provision of a tool of the type described which is adapted to draw a strap through a buckle essentially in a direction aligned with the passage through the buckle.

To attain these objects and such further objects as may appear herein or be hereinafter pointed out, reference is made to the accompanying drawings forming a part hereof, in which:

FIG. 3 is a fragmentary view similar to the view of FIG. 1 showing the position of the parts during the tightening mode;

FIG. 4 is a magnified fragmentary section taken on the line 4—4 of FIG. 3;

FIG. 5 is a section taken on the line 5—5 of FIG. 4;

FIG. 6 is a fragmentary view similar to FIG. 1 showing the position of the parts after tightening has been completed;

FIG. 7 is a side elevational view of the tool used in conjunction with a thin metallic strap;

FIG. 8 is a top plan view taken in the direction of line 8—8 of FIG. 7;

FIG. 9 is a vertical section taken on the discontinuous line 9—9 of FIG. 7;

FIG. 10 is a view similar to FIG. 7 showing the position of the parts during the tightening operation;

FIG. 11 is a fragmentary section taken on the line 11—11 of FIG. 10;

FIG. 12 is a section taken on the line 12—12 of FIG. 11;

FIG. 13 is a view similar to FIG. 7 showing the position of the parts when tightening has been completed.

Figure 1:
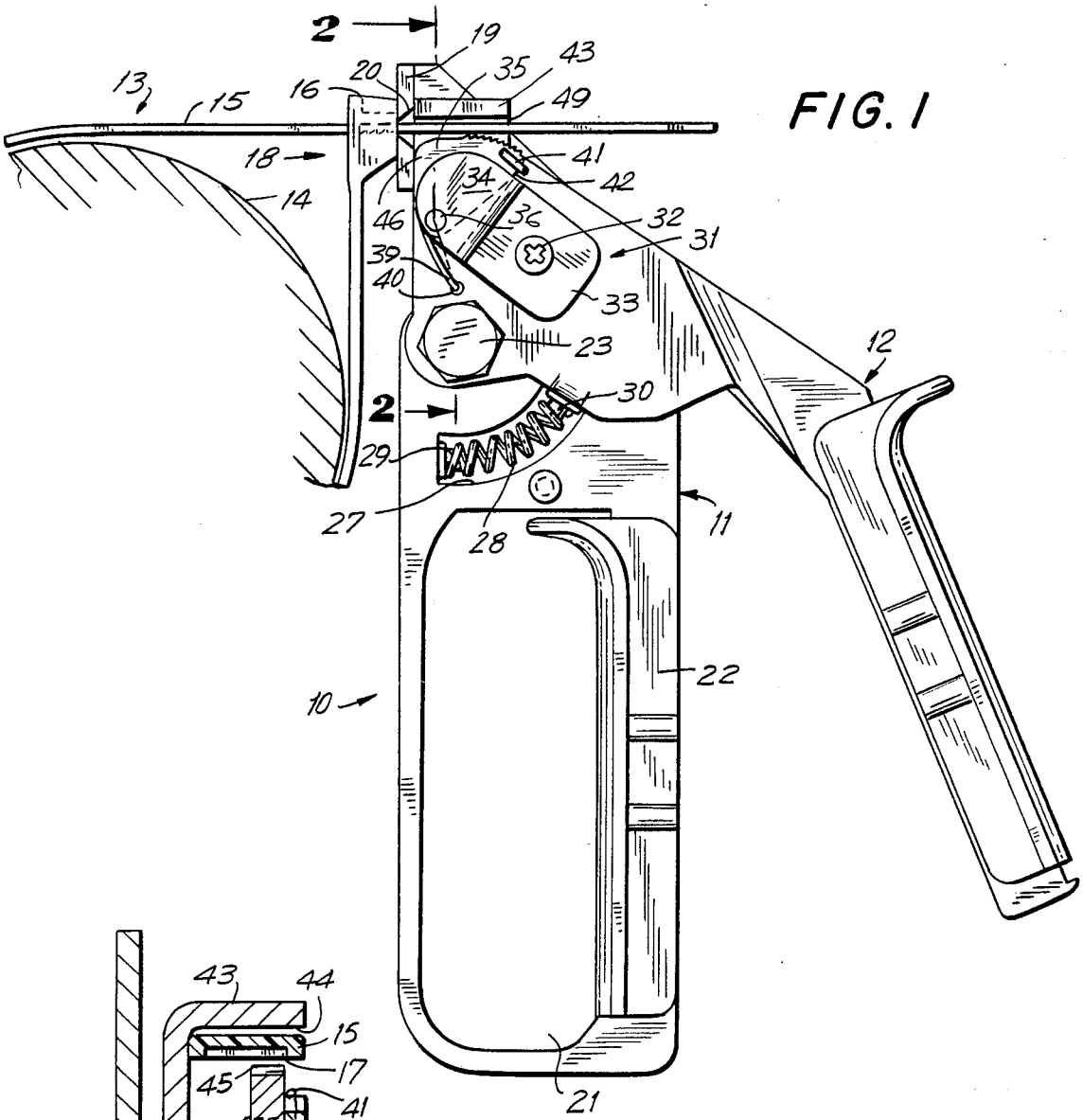
FIG. 1 is a side elevational view of a tool of the type described illustrated in conjunction with a nylon strap.
Figure 2:
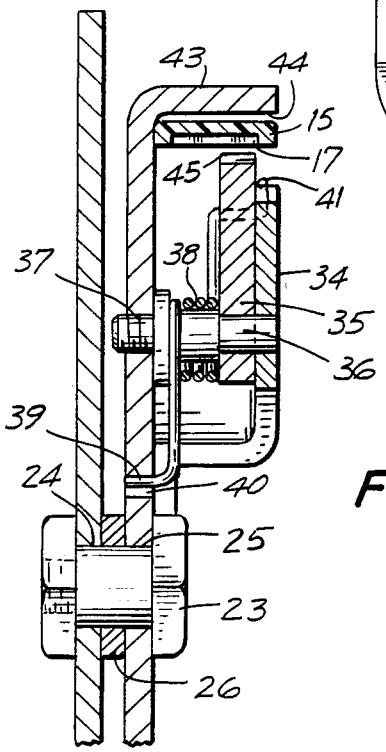
FIG. 2 is a magnified vertical section taken on the discontinuous line 2—2 of FIG. 1.

Referring now to the drawings, there is shown in FIG. 1 a tightening device 10 which is comprised of a fixed lever member 11 and a movable lever member 12. The tool 10 is intended to tighten a strap 13 about an object or objects 14.

Conventional strap 13 includes an elongate body portion 15 and a buckle 16 having a through passage formed therein. The strap includes a multiplicity of transversely directed teeth 17 which mesh with a pawl (not shown) within the buckle 16, the inclination of the teeth 17 and that or those of the pawl being such as to permit the strap to pass freely in the direction 18 (see arrow, FIG. 1) with deflection of the pawl, but to lock the strap against return movements through the buckle 16.

The fixed lever member 11 includes a flange 19 having a transversely extending opening 20 formed thereon. The flange 19 extends at right angles to the plane of the member 11. The member 11 may include a cutout portion 21 having a cushioned grip 22 accommodating the fingers of the installer.

The movable lever member 12 is pivotally mounted to the fixed member 11 as by a bolt 23 which spans aligned openings 24, 25 in the fixed and movable levers, respectively, a similarly apertured spacer member 26 being preferably seated on the bolt between the lever members.

The fixed lever member includes an arcuate slot 27 within which a helical spreader spring 28 is mounted. The ends of the spreader spring 28 encircle mounting lugs 29, 30 on the fixed and movable levers, respectively, with the result that the spreader spring urges the levers to the spread position shown in FIG. 1.

A mounting bracket 31 is secured to the movable lever 12, as by machine screw 32, the bracket including a mounting face 33 which is held against the mounting lever, and a pawl support branch 34 which is offset from and parallel to the lever 12.

A pawl member 35 is pivotally supported on pawl retainer pin 36, the inner end 37 of the pin being fixed to the lever 12. A coil spring 38 is convoluted about the pin 36, one end 39 of the spring being disposed within retainer aperture 40 on the movable lever, the other end 41 of the spring being hooked behind trailing face 42 of the pawl 35.

The movable lever 12 is provided with an inturned flange 43, the under surface 44 of which defines a clamp shoulder. The pawl 35 includes a clamp surface 45 which is directed toward the clamp shoulder 44.

As will be appreciated from the above, spring 38 biases the pawl in an anti-clockwise direction as viewed in FIG. 1 so as to urge the clamp surface 45 of the pawl toward the clamp shoulder 44.

The pawl 35 includes a tail piece 46 which, in the spread condition of the lever members 11, 12 illustrated in FIG. 1 butts against portions of the flange 19 of the fixed lever defining a pawl release shoulder. Since the force of the spring 28 is greater than that of the spring 38, the pawl 35, in the spread condition of the levers, will be pivoted in the clockwise direction and, thus, the clamp surface 45 thereof will be spaced from the clamp shoulder 44.

As thus far described, the device is essentially conventional.

A characterizing feature of the device resides in the provision on the clamp surface 45 of the pawl of two discrete sets of teeth, namely, a first set 47 and a second set 48. The crests of the teeth of the sets 47 and 48 are disposed at different distances from the pivot axis of the pivot pin 36, the crests of set 47 being closer to said pivot axis than are the crests of set 48. The rake angle of the teeth 47, 48 is coordinated with the rake angle of the teeth of the strap such that the strap cannot slip relative to the pawl during a tightening stroke.

The tightening operation of a relatively thick strap is illustrated in FIGS. 1 through 6.

As shown in FIG. 1, the strap 13 is encircled about the object 14 and the free end of the strap portion 15 passed outwardly through buckle 16. The free portion of the strap 15 is thereafter passed through the slot 20 and the clearance space 49 between the clamp shoulder 44 and the clamp surface 45 of the pawl.

When the movable lever member 12 is thereafter shifted toward the fixed member 11 (FIG. 3), pivotal movement of the levers removes the tail piece 46 of the pawl from its contact with flange 19, permitting the pawl to pivot anti-clockwise toward the clamp shoulder 44.

As seen in FIG. 5, the movement of the pawl will cause the teeth of set 47 to engage with the teeth 17 of the strap, drawing the strap through the buckle in a left to right direction as viewed in FIG. 3. When partial tightening of the strap has been achieved, the handles are released and the action of tightening and releasing continued until the parts reach the fully tightened position illustrated in FIG. 6.

Preferably portions of the flange 19 defining slot 20 are beveled or sharpened, as at 20*a*, 20*b*. Thus, when the tightened position of FIG. 6 is achieved, it is merely necessary to rotate the tool bodily about the longitudinal axis of the strap 15, which rotation will function to sever the strap at a position essentially coincident with the outermost surface of the buckle 16.

In FIGS. 7 through 13 the tool is disclosed in conjunction with the operation of tightening a thin metallic strap 50. The strap 50, which is preferably manufactured in accordance with the above referenced pending application, includes a buckle 51 formed integrally by bending one end of the strap about the axis of the strap in such manner as to define a clearance space for passage of the free end 52 of the strap.

Where a metallic strap is employed, it is preferable to secure to the outer face 53 of flange 19 an elongate guide member 54. The guide member 54 may be secured as by machine screw 55 passing through an aperture in the mounting plate 56 of the guide member, the machine screw being threadedly connected into a complementally tapped aperture (not shown) in flange 19.

A stablizing shoulder 57 may be provided on the guide member, which shoulder bears against side portions of the fixed lever 11 to secure the guide member against movement relative to the fixed lever.

The guide member 54 includes spaced upper and lower guide bars 58, 59, the bars defining therebetween a slot 60 which forms a continuation of the slot 20 in flange 19. The guide member 54 includes a nose 61 which, during the tightening operation, is butted against the buckle 51. As best seen in FIG. 7, in the final stages of tightening the nose 61 it is the upper guide bar 58 which bears against the buckle 51.

It will be understood that the buckle 51, unlike the plastic tie strap previously described, does not include a locking pawl. However, due to the limited resilience of the metal and its friction within buckle 51, there is little tendency for the strap to slide rearwardly through the buckle.

The strap 50 is tightened in the same manner as the strap 13, namely, the movable lever 12 is repeatedly shifted toward and away from fixed lever 11. During movements of the lever 12 toward lever 11, i.e. the tightening movements, it will be seen that the teeth of set 48 (see FIG. 12) will enter into the teeth 62 of the strap to effect the tightening.

As will be appreciated by comparing FIGS. 5 and 12, the teeth 48 perform essentially no function in the tightening of a thicker strap, such as the strap 13, whereas the teeth of set 47 perform no function during the tightening of a thinner strap, such as the strap 50.

By virtue of the use of the guide member 54, it will be appreciated from FIG. 13 that the strap emerging from buckle 51 exits from the buckle in a direction which is essentially a continuation of the direction of passage through the buckle.

After tightening has been completed in the embodiment of FIGS. 8 to 13, the strap is prevented from sliding rearwardly through the buckle by bending the tool 10 upwardly in the plane defined by the lever members. This movement provides a sharp bend of the strap at the junction of nose 61 of the guide and the buckle 51. By sharply bending the metal strap it is assured that the same is prevented from retractile movement through the buckle 51.

From the foregoing it will be appreciated that there is described a tightening tool which is useful in the tightening of straps of a variety of thicknesses. The tool is useful with straps having thicknesses differing somewhat from those illustrated since in all cases, by virtue of the provision of two sets of teeth, a multiplicity of teeth of one set will engage the teeth of the strap.

As will be evident to those skilled in the art, it is feasible to provide, for example, a third set of teeth to accommodate straps of greater thicknesses than those illustrated.

Numerous other variations will occur to those skilled in the art and familiarized with the instant disclosure and, accordingly, the same is to be broadly construed within the scope of the appended claims.

Having thus described the invention and illustrated its use, what is described as new and is desired to be secured by Letters Patent is:

1. In a flat strap tightening tool of the type which comprises a fixed lever member, a pivotal lever member mounted on said fixed lever member for relative pivotal movement between spread and contracted positions about a first pivot axis, spring means interposed between said lever members and urging said members to said spread position, a pawl mounted on said movable lever member for pivotal movement about a second pivot axis parallel to said first pivot axis, said pawl including a clamp surface, a clamp shoulder on said movable lever member in spaced relation to said second pivot axis, pawl spring means biased between said pawl and said movable lever member for urging said clamp surface of said pawl toward said clamp shoulder, a pawl release shoulder on said fixed lever member positioned to engage said pawl and pivot said clamp surface away from said clamp shoulder in said spread position of said levers, the improvement which comprises a first set of at least three strap gripper teeth on the portion of said clamp surface nearest said pawl release shoulder, a second set of at least three strap gripper teeth on said clamp surface spaced further from said pawl release shoulder than said first set of teeth, the crests of said teeth of said second set being located further from said second pivot axis than the crests of the teeth of said first set, the crests of the teeth within each set being in substantial coplanar alignment, the plane defined by said first set diverging from the plane defined by said second set, an elongate guide member mounted on said fixed lever member and extending outwardly beyond said clamp shoulder, said guide member including an elongate spaced parallel pair of fixedly positioned guide bars, one of said guide bars being in substantial axial alignment with the teeth of said pawl, the other of said guide bars being in substantial axial alignment with said clamp shoulder, the space between said guide bars defining a channel having a depth which is parallel to the plane of said clamp shoulder and sized to intimately slidably receive a flat strap to be tightened, said channel depth being normal to the plane of the pawl, said channel opening at the end of said guide member remote from said fixed lever member including a nose formed by only the end of said other guide bar and defining a stop member in the tightening mode of said tool.

* * * * *